US005199545A

United States Patent [19]

Takamisawa et al.

[11] Patent Number: 5,199,545

[45] Date of Patent: Apr. 6, 1993

[54] METAL BODY DISCRIMINATING APPARATUS

[75] Inventors: Kaihei Takamisawa, Saku; Masakazu Tokumura, Minamisaku, both of Japan

[73] Assignee: Takamisawa Cybernetics Co., Ltd., Tokyo, Japan

[21] Appl. No.: 757,468

[22] Filed: Sep. 10, 1991

[30] Foreign Application Priority Data

Feb. 28, 1991 [JP] Japan ..... 3-034620

[51] Int. Cl.[5] ..... G07D 5/08

[52] U.S. Cl. ..... 194/319

[58] Field of Search ..... 194/317, 318, 319

[56] References Cited

U.S. PATENT DOCUMENTS

| | | | |
|---|---|---|---|
| 4,059,795 | 11/1977 | Mordwinkin . | |
| 4,124,111 | 11/1978 | Hayashi | 194/319 X |
| 4,151,904 | 5/1979 | Levasseur et al. | 194/319 |
| 4,334,604 | 6/1982 | Davies | 194/319 |
| 4,354,587 | 10/1982 | Davis | 194/319 |
| 4,705,154 | 11/1987 | Masho et al. | 194/319 |
| 4,754,862 | 7/1988 | Rawicz-Szczerbo et al. | 194/319 |

FOREIGN PATENT DOCUMENTS

| | | |
|---|---|---|
| 57-98089 | 6/1982 | Japan . |
| 1-25030 | 5/1989 | Japan . |
| 8600410 | 1/1986 | World Int. Prop. O. . |

*Primary Examiner*—F. J. Bartuska

*Attorney, Agent, or Firm*—Wenderoth, Lind & Ponack

[57] ABSTRACT

In a metal body discriminating apparatus for discriminating the material, shape, size, or the like of a metal body, an oscillator performs a self-oscillating operation together with a coil wound like a ring provided to generate magnetic lines of force. Changes in frequency and amplitude of an oscillation signal in response to changes in impedance and inductance of the coil caused by an eddy current, which is generated in the metal body when the metal body moves through the coil, are detected as indicators of features of the metal body. Two or more of such coils may be arranged at regular intervals and the size of metal body will be discriminated based on signals having a phase difference which are obvious when the metal body passes sequentially through the coils.

10 Claims, 14 Drawing Sheets

METAL BODY DISCRIMINATING APPARATUS

BACKGROUND OF THE INVENTION

The present invention relates to a metal body discriminating apparatus for discriminating the material, shape, size, and the like of a metal object such as metal product, metal part, coin, etc. by using a magnetic field.

Hitherto, metal body discriminating sensors have been used, for instance, to discriminate a coin in an electronic coin detecting apparatus. Such apparatuses have been disclosed in JP-A-59-178592, JP-A-57-98089, JP-B-1-25030, International Publication W086/00410, U.S. patent application Ser. Nos. 4462513, 4493411, 4845994, and 4601380, and the like.

One typical example of such conventional electronic coin detecting apparatuses will be described hereinbelow with reference to FIGS. 15 to 19D. In FIG. 15, a coin 1, which has been inserted into the apparatus from a coin input port, rolls and moves in the electronic coin detecting apparatus along a guide rail 2 which is inclined downward to a front side A of the apparatus. The guide rail 2 has a width based on a thickness of the coins to be detected, an inclination angle, a flat surface, and the like so that the coin can roll smoothly. Movement in the lateral direction by the coin 1 is restricted by a side wall 3 which is formed perpendicularly to the surface of the guide rail 2 and a side plate (shown by a broken line) 4 which faces the side wall 3, thereby preventing the coin 1 from dropping from the guide rail 2.

The side wall 3 is slightly inclined in such a manner that when the coin 1 rolls along the guide rail 2, the coin 1 always slides against the surface of the side wall 3 due to the dead weight of the coin.

Detecting coils 5 and 6 are embedded in the side wall 3. A detecting coil 7 is embedded in the side plate 4 at a position which faces the detecting coil 5. The detecting coils 5 and 7 are provided in a positional relation such that when the coin 1 passes therebetween, the coils face almost the central portion of the coin. The detecting coil 6 is provided in a positional relation so as to face the peripheral portion of the coin 1 when the coin rolls therepast.

The detecting coils 5 to 7 are conventional metal body discriminating sensors. Each of the detecting coils has a copper wire 10 wound around a projecting portion 9 provided inside a cap-shaped ferrite core (pot core) 8 as shown in FIG. 16. The detecting coils 5, 6 and 7 are oriented in the side wall 3 and the side plate 4 so that each projecting portion 9 is directed toward a side of the coin 1 rolling therepast.

Each of the detecting coils 5, 6, and 7 detects the coin 1 with a detecting circuit combined with a bridge circuit as shown in, for instance, FIG. 17. That is, resistors $r_1$ and $r_2$ having predetermined resistance values and an adjusting resistor $R_1$ and an adjusting coil $L_1$ whose values have been preset to appropriate values are connected to form an oscillating circuit 11 of a predetermined frequency. A detecting coil $L_0$ (corresponding to the detecting coil 5, 6, or 7) constitutes one side of the bridge circuit, whereby the circuit generates a detection signal S at a predetermined output contact.

Thus, as shown in FIG. 18, the detecting coils 5, 6, and 7 driven by the oscillating circuit 11 generate magnetic lines of force (shown by broken lines in the diagram) having predetermined magnetic flux densities and which extend into the path of the coin 1. The bridge circuit is set into an equilibrium state by changes in inductances and impedances of the detecting coils 5, 6, and 7 which are caused due to influences by eddy currents generated in the coin 1 when the coin 1 traverses the magnetic lines of force. Thus, a detection signal S which is indicative of a feature of the coin 1 is generated. The detecting coils 5 and 7 face each other and form a magnetic circuit (corresponding to an inductance $L_0$ in FIG. 17), thereby generating magnetic lines of force which perpendicularly traverse the path of the coin 1. The coin 1 is detected when it passes through the magnetic lines of force. On the other hand, as shown in FIG. 18, the detecting coil 6 generates magnetic lines of force on one side of the path of the coin 1, so that the coin I is influenced by the magnetic lines of force only at one side thereof.

The coin detecting operation of the apparatus will now be described with reference to FIGS. 19A to 19D. The above diagrams show that when the coin 1 rolls toward the front side A along the guide rail 2, the detection signal S which is generated from the detecting circuit changes in accordance with changes in relative positions between the coin 1 and the detecting sensors 5 and 7.

When the coin 1 is away from the above detecting sensors as shown at a certain time point $t_1$, the bridge circuit in FIG. 17 is not in its equilibrium state, so that a detection signal S (refer to FIG. 19B) having the same frequency f and amplitude H as those of the output signal of the oscillator 11 is generated.

As shown at a time point $t_2$, when the front portion of the coin 1 moves inbetween the detecting coils 5 and 7, an eddy current is generated in that portion of the coin due to the magnetic lines of force, so that the inductance $L_0$ of the bridge circuit changes and the amplitude of the detection signal S changes (refer to FIG. 19*c*). When the coin 1 further progresses between the detecting coils 5 and 7, the level of the eddy current which is generated also gradually increases and the amplitude of the detection signal S also changes in accordance with the change in eddy current.

As shown at a time point $t_3$, when the central portion of the coin 1 coincides with the central portions of the detecting coins 5 and 7, the eddy current which is generated in the coin 1 becomes maximum and the amplitude of the detection signal S becomes minimum in accordance with the adjusting resistor $R_1$ and the coil $L_1$ (refer to FIG. 19D).

On the contrary, when the coin 1 moves away from the detecting coils 5 and 7, in a manner similar to the case shown in FIG. 19C, the amplitude of the detection signal S increases. After a time point $t_4$ when the coin 1 is completely away from the detecting coils 5 and 7, the magnetic lines of force generated by the detecting coils 5 and 7 are not influenced by the coin 1. The amplitude of the detection signal S finally approaches the amplitude of the output signal of the oscillating circuit 11 in a manner similar to the case shown in FIG. 19B.

On the other hand, the detecting circuit associated with the detecting coil 6 also generates a detection signal S which changes in accordance with the portion of the coin 1 confronting the detecting coil 6 in a manner similar to the above case.

The detection signals S and s are analyzed and the diameter, thickness, material, deformation, and the like of the coin are judged from changes in the patterns and minimum amplitude values of the detection signals S and s, thereby discriminating a denomination, a fake coin, and the like.

The detection signal S which is generated by the detecting circuit using the detecting coils 5 and 7 is a signal which is indicative of the size, material, and thickness of the coin. The detection signal s which is generated by the detecting circuit using the detecting coil 6 is indicative of the thickness and diameter of the coin.

However, the metal body discriminating sensors comprising the detecting coils, and the metal body discriminating apparatus such as a coin detecting apparatus or the like using such sensors, have the following problems.

A coin or the like moves past the front surfaces of the detecting coils while rolling along the guide rail. If dust or dirt has been deposited on the guide rail due to environmental conditions surrounding the apparatus at the time of manufacture or with the lapse of time, the coin (metal body) won't roll smoothly on the guide rail but will jump thereon. In such a case, the positional relation between the metal body and the detecting coils is deviated from the normal state and the detection signals are distorted and an error occurs in the discrimination. That is, the guide rail functions as a reference surface to position the metal body such as a coin or the like and there is a drawback in that when the position of the metal body deviates from the position to be provided by the reference surface, the measurement cannot be performed with a high degree of accuracy.

Consequently, for instance, the maintenance of periodically cleaning the inside of the apparatus or the like is difficult and a cleaning apparatus or the like needs to be provided.

Further, the coin or the like must slide along the side wall 3 in order to move smoothly a'ong the guide rail and to establish a set distance between the coin or the like and the detecting coil, i.e. to maintain a constant line when the coin or the like passes by the detecting coils. For this purpose, it is necessary to provide the inclination angle of the guide rail 2 and the inclination angle of the side wall 3 with a high degree of accuracy. Since the moving characteristics of the coin or the like also are affected by the material of the guide rail 2 and the material of the side wall 3, those materials also must be appropriately selected.

The intensities of the magnetic lines of force which are generated from the detecting coils 5 and 7 which face each other as shown in FIG. 18 are affected by the distance between the detecting coils 5 and 7. Therefore, the side wall 3 and the side plate 4 need to be held assembled accurately with a constant distance provided therebetween. In addition the detecting coils 5 and 7 must be embedded in the side wall 3 and the side plate 4 under a high degree of mechanical accuracy (i.e., small tolerance). It is, however, difficult to provide such accuracy and it is necessary to frequently execute adjustments. For instance, if a deformed coin or the like has become stuck on the guide rail, it is necessary to detach the side plate 4 and extricate the coin or the like. Therefore, the side wall 3 and the side plate 4 must often be reassembled, whereby their positional accuracy gradually deteriorates. Since such a deterioration influences the characteristics of the detection signals, the absolute measuring accuracy may become low. For instance, a coin detecting apparatus for discriminating Japanese coins is generally set to up to discriminate four kinds of coins. An adjusting device, a differential amplifier, and a comparator are thus needed for every denomination as will be obviously understood from FIG. 8 in JP-A-61-262990.

As mentioned above, in the metal body discriminating apparatus such as a coin detecting apparatus using conventional metal body discriminating sensors, to improve the detecting accuracy it is extremely important to improve the accuracy in the mechanical aspects, e.g. positional relationships of the elements, of the apparatus. There are so many problems to be solved that each apparatus must be individually adjusted, and the maintenance thereof is complicated, and like.

SUMMARY OF THE INVENTION

It is an object of the invention to provide a novel metal body discriminating apparatus in which a remarkably high detecting accuracy is obtained, the structure thereof is simple and economical to produce, and routine mechanical maintenance is almost unnecessary.

Still another object of the invention is to provide a metal body discriminating apparatus which can discriminate many denominations of coins by employing only a simple circuit.

To achieve the above objects, the invention provides a metal body discriminating apparatus which discriminates a metal body using principles of electromagnetism.

More specifically, to achieve the above objects, according to the invention, there is provided a metal body discriminating apparatus comprising: an oscillator, including a coil wound like a ring, for executing an oscillating operation; a frequency detecting circuit to detect a frequency of an AC signal which is generated by the oscillator; and a detecting circuit to detect an envelope of the AC signal, wherein the frequency and amplitude of the AC signal change in association with changes in impedance and inductance of each coil which occur due to an eddy current which is generated in the metal body by magnetic lines of force of the coil when the metal body moves through the space within the coil, and whereby the material of the metal body can be discriminated based on the frequency change and the shape of the metal body can be discriminated based on the change of the envelope.

To achieve the above objects, according to the invention, there is also provided a metal body discriminating apparatus comprising: oscillators each having a respective coil wound like a ring, adjacent coils of the oscillators being arranged parallel at a predetermined spacing from one another; frequency detecting circuits to detect the frequency of AC signals which are generated in the oscillators; and detecting circuits to detect envelopes of the AC signals, wherein the frequency and amplitude of the AC signals change in association with changes in impedance and inductance of each coil which occur due to an eddy current which is generated in the metal body by magnetic lines of force when the metal body moves through the spaces within the coils and whereby the space and material of the metal body can be discriminated by analyzing the signals which are generated from each frequency detecting circuit and each detecting circuit alone and in combination.

With the above structures, the magnetic flux densities of the magnetic lines of force which are generated in the spaces defined within the coils are uniform. A metal body is moved into the uniform magnetic lines of force. Therefore, even if there is a relative positional deviation between the coil and the metal body, the accuracy of signals output from an oscillator including the coil is not influenced, whereby a feature of the metal body can be measured with a high degree of accuracy.

Therefore, the drawback of using the conventional detecting coils, wherein the relative positional relation between the metal body and the detecting coils directly exerts an influence on the accuracy of measurements, is eliminated. By merely moving a metal body having a feature to be measured through the coil of the metal body discriminating sensor of the present invention, the feature can be measured with a high degree of accuracy. For instance, by merely dropping a metal body through the coil, highly accurate measurements of the metal body can be obtained. The means, such as a guide rail or the like, to provide a constant relative positional relation between the metal body and the coil in the conventional coin detecting apparatus, for example, and the means for finely adjusting the inclination of the guide rail, are unnecessary.

The coil as a metal body sensor has an extremely simple structure, is economical to manufacture, hardly requires mechanical adjustments and is not influenced by differences in environmental conditions or the like. Thus, the present invention is significantly maintenance free.

The circuit which can indicate features of the metal body as changes in impedance and inductance of the coil is extremely simple. Even if the circuit is combined with the metal body sensor, a remarkably simple apparatus which is compact and light can be realized.

Further, in the case where two or more coils are arranged at a predetermined interval along the path of the metal body, which interval is of a predetermined value corresponding to a dimension, such as a diameter or the like, of the metal body, when the metal body passes through each coil, changes in the detection signals caused by changes in inductance and impedance of each coil occur with a phase deviation in terms of time. The dimension, such as diameter or the like of the metal body, can be discriminated based on the deviations of the detection signals.

The shape of a hollow body of the device which forms the space within the coil wound therearound is properly selected in accordance with a shape or the like of the metal body. Variously shaped hollow bodies may be employed by the present invention.

It is preferable that the hollow body have the minimum inner cross-sectional area and shape necessary to allow the metal body to pass therethrough in order to achieve maximum measuring accuracy.

DETAILED DESCRIPTION OF THE PREFERRED EMBODIMENTS

Figure 1:
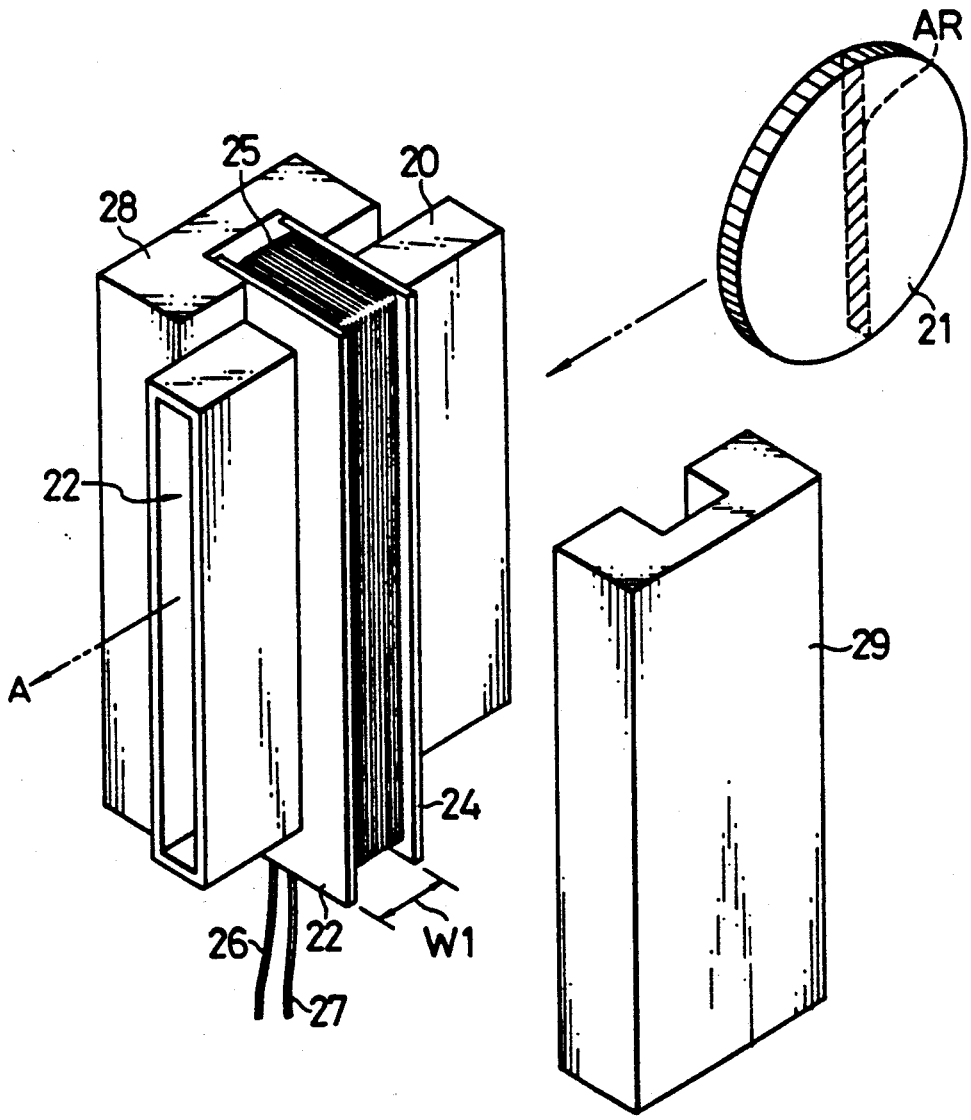
FIG. 1 is a perspective view of one embodiment of a metal body sensor of a metal body discriminating apparatus according to the present invention.

In FIG. 1, reference numeral 20 denotes a columnar body which has a hole 22 sized to receive a metal body 21 such as a coin or the like and is molded of plastics or the like. A pair of flange portions 23 and 24 are integrally formed with the outside wall of the columnar body 20 and are nearly parallel with a predetermined interval $W_1$ therebetween.

Reference numeral 25 denotes a coil. A relatively thin copper wire which has been coated and insulated is wound by only a predetermined number of turns T around the outside wall of the columnar body 20 as sandwiched by the flange portions 23 and 24, thereby forming the coil 25. Both ends 26 and 27 of the copper wire of the coil extend to the outside of the sensor.

Reference numeral 28 denotes a U-shaped core made of ferrite or the like having a concave portion fitted to the outside walls of the flange portions 23 and 24. Although the diagram shows an exploded state, a core 29 of the same material and shape as those of the core 28 is fitted to the outside walls of the flange portions 23 and 24 in a manner similar to the core 28, so that the cores 28 and 29 face each other when assembled.

Figure 2:
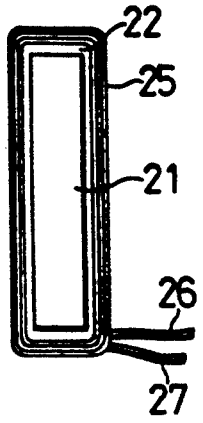
FIG. 2 is an explanatory diagram showing a positional relation between a coil of the metal body sensor and a metal body.

The hole 22 has a similar but slightly larger shape than a diametrical cross section AR (shown by a matched region in the diagram) of the metal body 21. As shown in FIG. 2, therefore, the metal body 21 can pass through the hole 22 while keeping a slight gap between the metal body 21 and the columnar body 20. The hole 22 is provided for allowing the metal body 21 to pass through the coil 25. The hole 22 is not provided to cause any particular part of the metal body 21 to pass through the coil 25 with a high degree of positional accuracy but is provided to simply guide the metal body 21.

Figure 3:
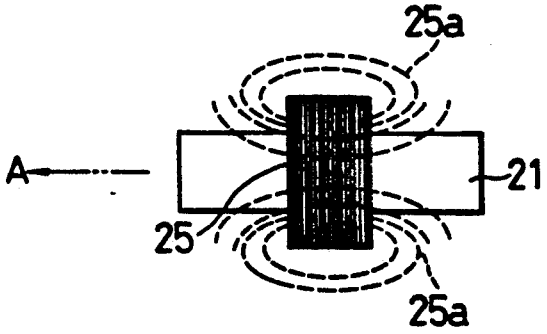
FIG. 3 is an explanatory diagram showing a principle under which the metal body discriminating apparatus of the present invention operations.

When the metal body discriminating sensor is in use, an AC signal, which will be explained hereinafter, is supplied between both ends 26 and 27 of the winding of the coil 25, whereby magnetic lines of force 25*a* of a predetermined magnetic flux density are generated in the coil 25 as shown in FIG. 3. By allowing the metal body 21 to pass through the hole 22, the metal body 21 is subjected to the magnetic lines of force 25*a*.

Figure 4:
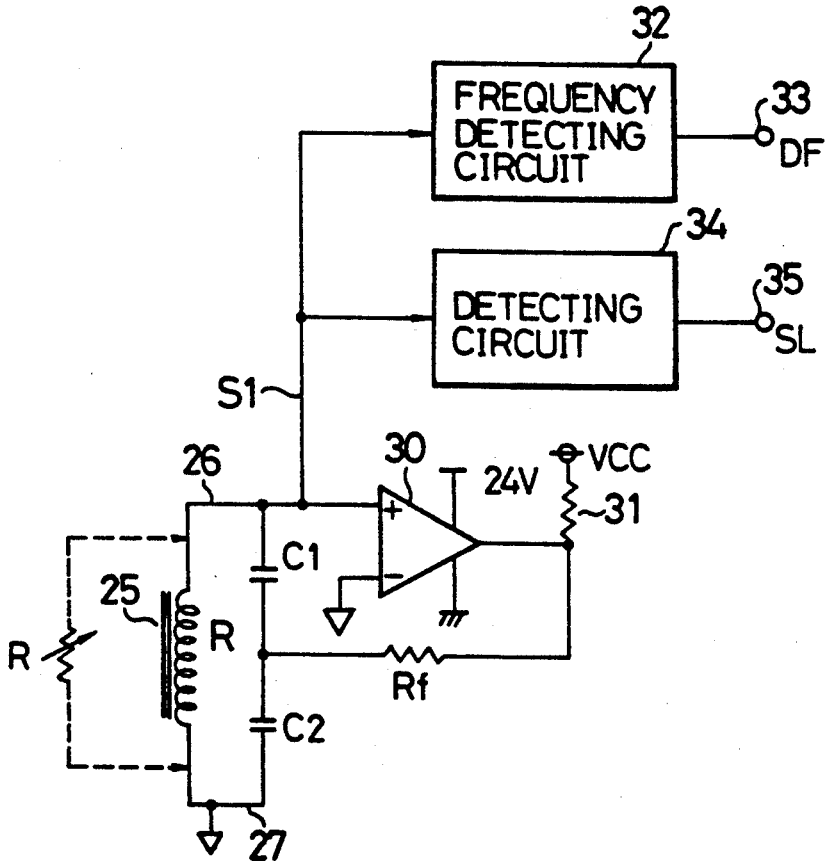
FIG. 4 is a circuit diagram of a detecting circuit of the metal body discriminating apparatus.

A detecting circuit will now be described with reference to FIG. 4. In FIG. 4, capacitors $C_1$ and $C_2$ are serially connected between both ends 26 and 27 of the coil 25. The end 26 of the coil 25 is further connected to a non-inverting input contact of a comparator 30. The comparator 30 is operated by a power source of a predetermined voltage. An inverting input contact of the comparator 30 is connected to a ground contact. An output contact of the comparator 30 is connected to a common connecting contact of the capacitors $C_1$ and $C_2$ through a feedback resistor $R_f$.

When the metal body 21 passes through the coil 25, an inductance and an impedance of the coil 25 are changed due to the influence of an eddy current which is generated in the metal body 21. Therefore, in the diagram, a change in impedance is equivalently shown by reference character R. The inductance (L) of the coil 25 theoretically changes in accordance with the relation expressed by the following equation.

$$L = K \cdot \mu \cdot N^2 \cdot S \cdot l \cdot 10^{-7} \quad \text{(H)}$$

Where,

K: Nagaoka coefficient

L: Inductance $\mu$: Permeability of the metal body

N: The number of turns of the coil

S: Cross-sectional area of the coil l: Length of the coil (corresponding to a width $W_1$ in FIG. 1)

A circuit comprising the comparator 30, capacitors $C_1$ and $C_2$, resistor $R_f$, and coil 25 constitutes a Colpitts type oscillator and generates an AC signal $S_1$ of a frequency and an amplitude which are established by circuit constants of a tuning circuit comprising the capacitors $C_1$ and $C_2$ and coil 25. The frequency of the AC signal $S_1$ changes in accordance with changes in inductance and impedance R when the metal body 21 passes into the magnetic lines of force 25*a* which are generated by the coil 25. The frequency of the signal S thus corresponds to the permeability of the metal body 21.

Reference numeral 32 denotes a frequency detecting circuit for detecting the frequency of the signal $S_1$ appearing at the end 26 of the coil and for issuing a signal $D_f$ of a rectangular waveform having a frequency equal to that of the signal $S_1$ to an output terminal 33.

Reference numeral 34 denotes an envelope detecting circuit for detecting an envelope of a positive amplitude of the signal $S_1$ and for issuing an envelope signal SL to an output terminal 35.

Figure 5A:
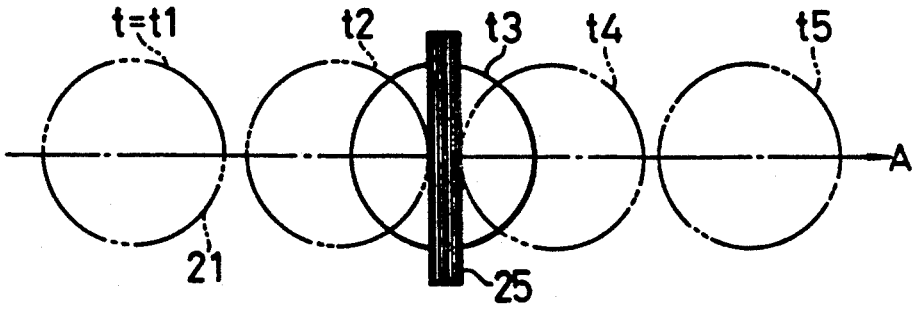
FIG. 5A is a timing diagram for explaining the operation of the metal body discriminating apparatus.
Figure 5B:
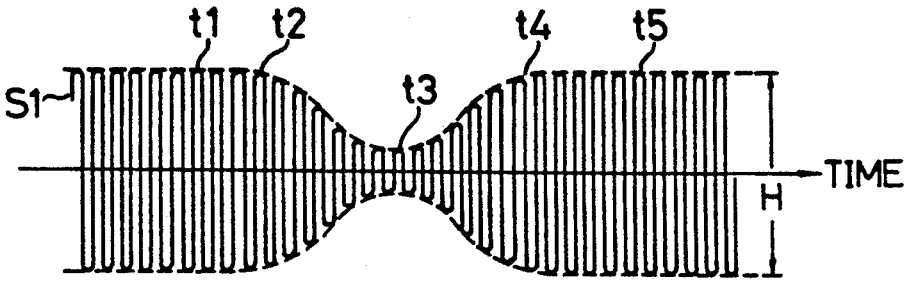
FIG. 5B is a waveform diagram showing an output signal $S_1$ of the coil in correspondence with the timing shown in FIG. 5A.
Figure 5C:
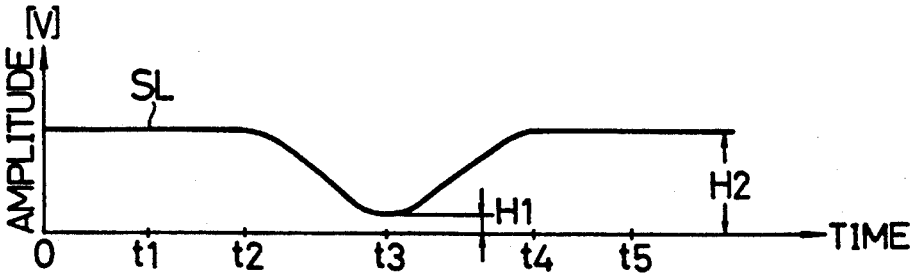
FIG. 5C is a waveform diagram showing an output signal SL of a detecting circuit in correspondence with the timing shown in FIG. 5A.
Figure 5D:
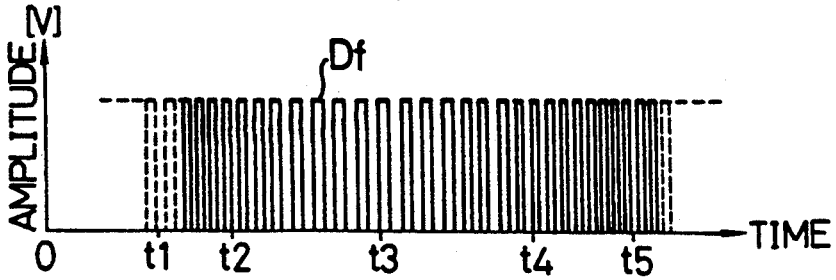
FIG. 5D is a waveform diagram showing an output signal $D_f$ of a frequency detecting circuit in correspondence with the timing shown in FIG. 5A.

The operation of the circuit shown in FIG. 4 will now be described with reference to FIGS. 5A to 5D. FIG. 5B shows a change in signal $S_1$ which is generated in the tuning circuit when the metal body 21 such as a coin or the like passes through the coil 25 of the discriminating sensor in the direction shown by arrow A in FIG. 5A. FIG. 5D shows a change in the signal $D_f$ which is generated by the frequency detecting circuit 32 and issued to the output terminal 33. FIG. 5C shows a change in the signal SL which is generated by the detecting circuit 34 and issued to the output terminal 35.

When the metal body 21 is away from the coil 25 as occurs before a time point $t_1$, the metal body is not subjected to the magnetic lines of force, and so a signal $S_1$ of a predetermined frequency and an amplitude is generated in a state in which there is no change in inductance and impedance R of the coil 25. Therefore, the signal SL which is being generated by the detecting circuit 34 has a constant amplitude $H_2$. Similarly, the output signal $D_f$ of the frequency detecting circuit 32 appears as a rectangular wave of a predetermined frequency.

At a time point $t_2$, when the front edge of the metal body 21 enters the space within the coil 25, an eddy current is generated at the front edge due to the magnetic lines of force. At the same time, the inductance and impedance R of the coil 25 change and the frequency and amplitude of the signal $S_1$ change. Particularly, the frequency is influenced by the permeability of the metal body 21 and the amplitude is influenced by an amount corresponding to the cross-sectional area of that portion (the front edge) of the metal body 21 that has entered the space within the coil 25.

When the metal body 21 further progresses into the coil 25, the eddy current also gradually increases. The changes in frequency and amplitude of the signal $S_1$ also increase in accordance with the change in eddy current.

An amplitude of the output signal SL also decreases in accordance with the change in signal $S_1$ and the frequency of the output signal $D_f$ also changes. The figures show the results of experiments using a metal body made of a material having a permeability higher than that of air. In such a case, as the amount of the metal body 21 entering the space within the coil 25 increases, the frequency of the signal $S_1$ decreases. (On the contrary, when using a metal body made of a material whose permeability is lower than that of the air, as the amount of the metal body 21 entering the space within the coil 25 increases, the frequency of the signal $S_1$ rises.)

As shown at a time point $t_3$, when the central portion of the metal body 21 coincides with the central portion of the coil 25, since the metal body 21 is made of material having a permeability higher than that of air, the eddy current which is generated by the metal body 21 becomes maximum, the amplitudes of the signals $S_1$ and SL become minimum, and the frequency of the output signal $D_f$ becomes lowest.

In an interval from time point $t_3$ to time point $t_5$, when the metal body 21 moves out of the coil 25, the frequency and amplitude of the signal $S_1$ also change, i.e. gradually return to the original values. When the metal body 21 is completely away from the coil 25, the original frequency and amplitude of the signal $S_1$ return (for instance, to the frequency and amplitude at time point $t_1$).

As mentioned above, the amplitude of the output signal SL and the frequency of the output signal $D_f$ change in accordance with the material of the metal body 21 and the cross-sectional area thereof. By analyzing the signals SL and $D_f$ with a conventional signal processing circuit (not shown), the metal body 21 can be identified in terms of its shape such as in terms of its size, thickness, and the like and in terms of its material such as in terms of its permeability and the like. Thus, the above method can be used to identify coins or the like.

Figure 6:
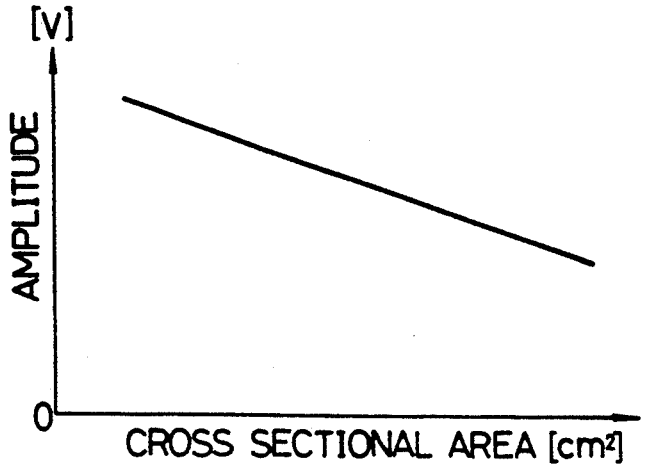
FIG. 6 is a graph of the characteristics of a detection signal generated by the metal body discriminating apparatus.
Figure 7:
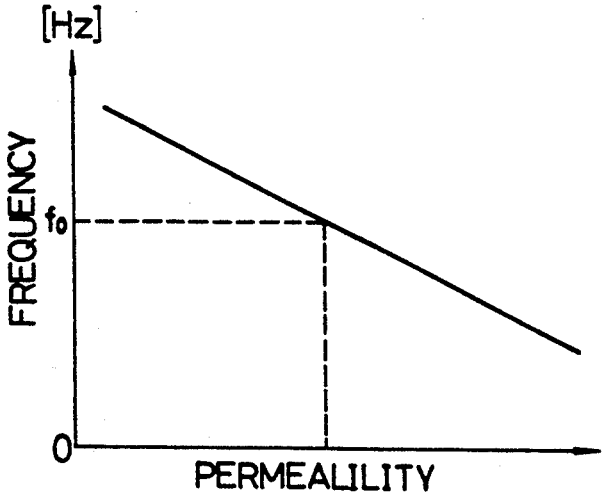
FIG. 7 is a graph of another characteristic of the detection signal generated by the metal body discriminating apparatus.

That is, as shown in FIG. 6, the amplitude of the output signal SL decreases the larger cross-sectional area of the metal body 21 becomes. Also, the frequency of the output signal SL decreases the larger the permeability of the metal body 21 becomes. Therefore, as shown in FIG. 5C, a difference between the minimum amplitude $H_1$ and the maximum amplitude $H_2$ of the signal SL is proportional to the diameter and thickness of the coin with a high degree of accuracy. The coin can be selected and discriminated based on its shape as determined on the basis of the change in amplitude of the signal SL. On the other hand, since there is a high correlation between the frequency change of the signal $D_f$ shown in FIG. 5D and the permeability of the coin, by checking such a frequency change, the coin can be selected and discriminated based on its material. By batch processing the above detection data, a discriminating process of even higher accuracy can be realized.

As mentioned above, the metal body discriminating apparatus according to the present invention has an extremely simple structure which allows the metal body to be measured to pass through the coil in which the magnetic flux density of the magnetic lines of force which are generated by an AC signal is most stable. The shape and material of the metal body are discriminated from the changes in inductance and impedance of the coil due to a change in eddy current which is generated in the metal body. Thus, the measuring accuracy is remarkably improved as compared with that in the conventional case in which the metal body is discriminated by the detecting sensors.

When the metal body passes through the coil whose magnetic flux density is uniform, the accuracy of the positional relation between the coil and the metal body doesn't influence the measuring accuracy. It is sufficient to merely allow the metal body to pass through the coil and there is no need to provide the conventional guide rail as a reference surface or the like.

A plurality of parameters which are necessary to identify the metal body are detected by simple structure comprising the oscillator which resonates and includes the coil of the discriminating sensor, the frequency detecting circuit, and the detecting circuit. Therefore, the coin detecting apparatus and other metal body discriminating apparatus according to the present invention are relatively simple, light and compact. Further, since there is no adjusting portion, the number of necessary repair and adjustment operations and the like are relatively few.

Figure 8A:
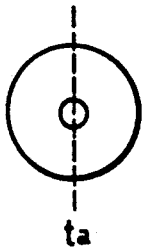
FIG. 8A is a schematic diagram of an example of an object having a special shape which can be discriminated by the present invention.
Figure 8B:
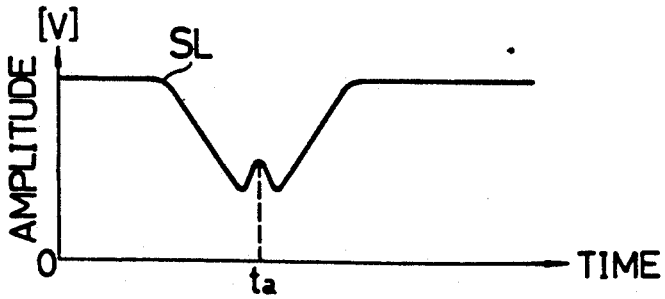
FIG. 8B is a graph of the characteristic of a detection signal explaining how the object shown in FIG. 8A can be discriminated.

Further, as shown in FIG. 8A, in the case of discriminating a metal body of a special shape having a hole in the central portion thereof, for example, 5-yen or 50-yen Japanese coin, if the center of the coil 25 coincides with the hole of the coin at a time point $t_a$, a mountain-like (peak) amplitude appears in a valley-like portion of the output signal SL as shown in FIG. 8B. The presence or absence of the hole or protuberance can be determined from the magnitude and duration of the mountain-like amplitude portion of the signal SL. As mentioned above, not only can the outer shape of the metal body be determined but the shape of a radially inner part can be determined as well. Many kinds of metal bodies having different shapes can be discriminated.

In the embodiment described above, the cores 28 and 29 have been provided for the coil 25 so that the coil 25 will not be influenced by any external magnetic field. If the coil 25 is used in an apparatus which is not subject to the influences of an external magnetic field, the cores 28 and 29 can thus be omitted.

Figure 9:
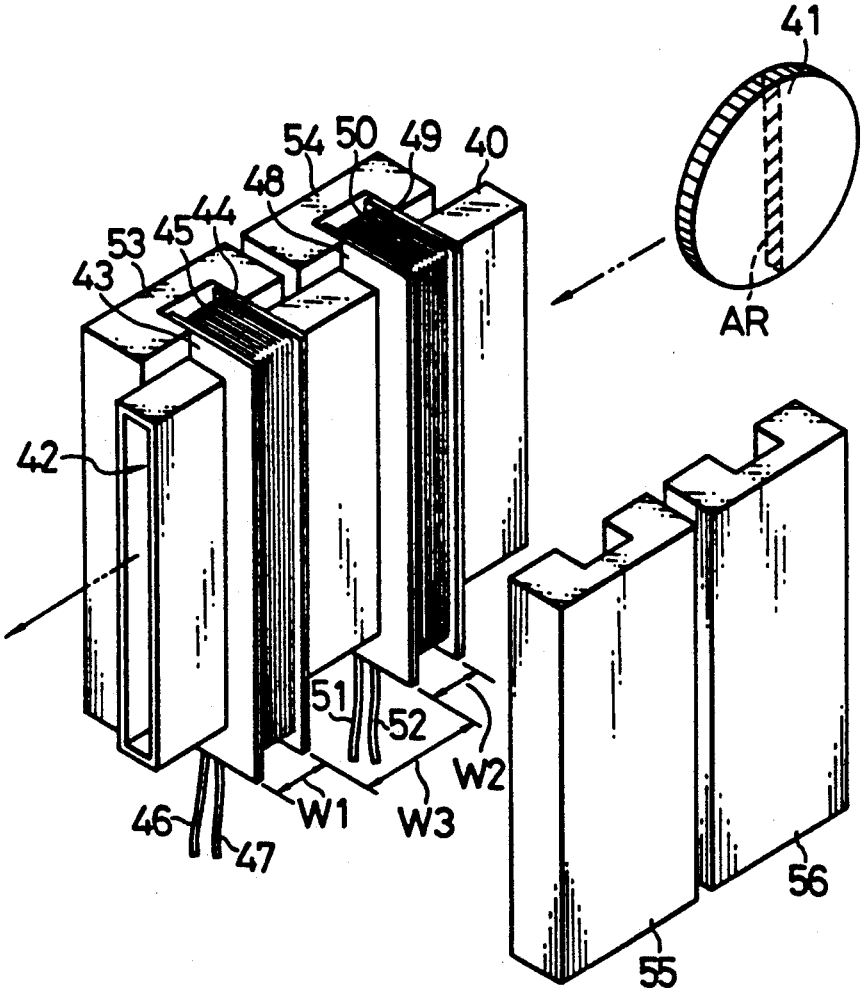
FIG. 9 is a perspective view of a metal body sensor used in another embodiment of a metal body discriminating apparatus according to the present invention.

As shown in FIG. 9, a second embodiment of the present invention comprises two detecting circuits each having the structure of a detecting circuit of the first embodiment. That is, in FIG. 9, reference numeral 40 denotes a columnar body which has hole 42 sized to receive a metal body 41 such as a coin or the like and is molded of plastics or the like.

A pair of flange portions 43 and 44 are integrally formed on the outside wall of the columnar body 40 and face each other with a predetermined interval $W_1$ therebetween. A relatively thin copper wire which has been coated and insulated is wound by only a predetermined number of turns T around the outside wall of the columnar body 40 as sandwiched by the flange portions 43 and 44, thereby forming a first coil 45. Both ends 46 and 47 of the copper wire of the coil 45 extend to the outside of the sensor.

Further, a second coil 50 having the same structure as that of the first coil 45 is wound around the columnar body 40 at a predetermined distance from the first coil 45. That is, a flange portion 48 is provided at a predetermined interval $W_3$ from the flange portion 44 and, further, a flange portion 49 is formed at a predetermined interval $W_2$ from flange portion 48. A relatively thin copper wire which has been coated and insulated is wound by only a predetermined number of turns T around the outside wall of the columnar body as sandwiched by the pair of flange portions 48 and 49, thereby forming the second coil 50. Both ends 51 and 52 of the copper wire of the coil 50 extend to the outside of the sensor.

Reference numerals 53 and 54 denote U-shaped cores of a ferrite or the like having the same shape although they are separately provided. A concave portion of the core 53 is fitted to the outside walls of the flange portions 43 and 44. A concave portion of the core 54 is fitted to the outside walls of the flange portions 48 and 49.

Although FIG. 9 illustrates an exploded state, a core 55 of the same material and shape as those of the core 53 is fitted to the outside walls of the flange portions 43 and 44 in a manner similar to the case of the core 53. A core 56 of the same material and shape as those of the core 54 is fitted to the outside walls of the flange portions 48 and 49 in a manner similar to the case of the core 54.

In using this embodiment as an apparatus, such as a coin detecting apparatus, for discriminating various kinds of metal bodies having different diameters, the interval $W_3$ is set to a value which is almost equal to a diameter of the metal body of the smallest diameter. For instance, in the case of the coin detecting apparatus for use in Japan, the interval $W_3$ is set to a value which is almost equal to a diameter of a 1-yen coin having the smallest diameter among 1-yen, 5-yen, 10-yen, 50-yen, 100-yen, and 500-yen coins which are used in Japan.

Figure 10:
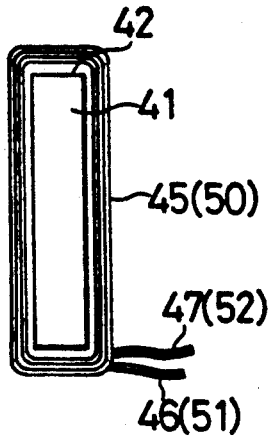
FIG. 10 is an explanatory diagram showing a positional relation between a coil of the metal body sensor shown in FIG. 9 and a metal body.

On the other hand, the hole 42 has a similar but slightly larger shape than a diametrical cross section AR (shown by a hatched region in the diagram) of the metal body 41. Therefore, as shown in FIG. 10, the metal body 41 can pass through the hole 42 while keeping a slight gap between the metal body 41 and the columnar body 40. The hole 42 allows the metal body 41 to pass through the coils 45 and 50. The hole 42 is not provided to cause any particular part of the metal body 41 to pass through the coils 45 and 50 with a high degree of positional accuracy but is provided to simply guide the metal body 41.

Figure 11:
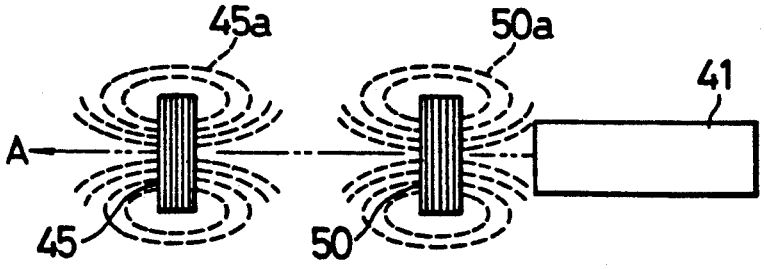
FIG. 11 is an explanatory diagram showing a principle under which the second embodiment of the metal body discriminating apparatus of the present invention operates.

The metal body discriminating apparatus has a detecting circuit comprising two detecting circuits each having the same structure as that shown in FIG. 4 and connected to the coils 45 and 50, respectively. As shown in the schematic diagram of FIG. 11, magnetic lines of force 45*a* and 50*a* are generated by the coils 45 and 50, respectively, and the metal body 41 is allowed to pass through the magnetic lines of forces 45*a* and 50*a*.

Figure 12A:
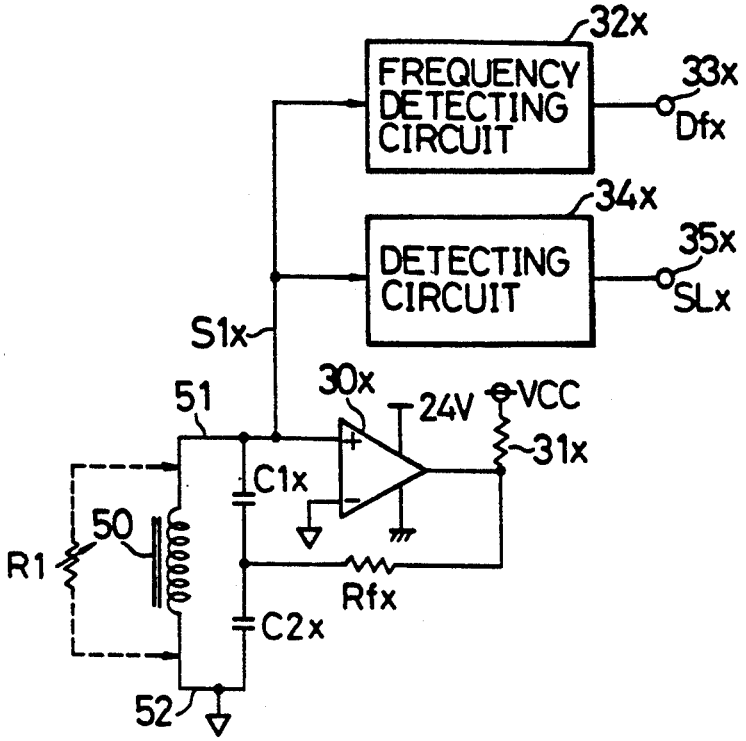
FIG. 12A is a circuit diagram of one detecting circuit of the second embodiment of the metal body discriminating apparatus.
Figure 12B:
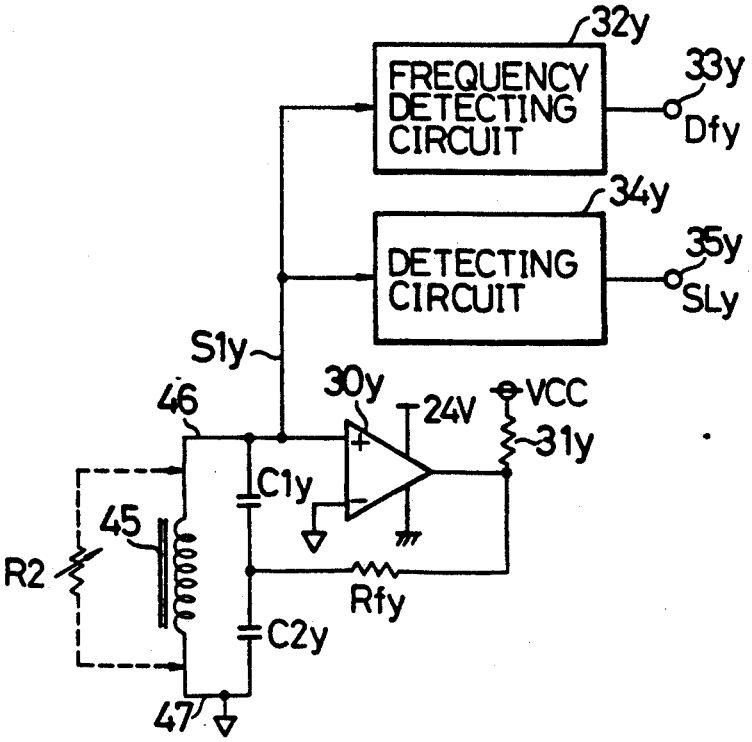
FIG. 12B is a circuit diagram of the other detecting circuit of the second embodiment of the metal body discriminating apparatus.

FIGS. 12A and 12B show the circuits which are respectively connected t the coils 45 and 50. Reference numeral $R_1$ denotes a variable amount of impedance of the coil 50 which changes due to an eddy current which is generated in the metal body 41 when the metal body 41 passes into the magnetic lines of force generated by the coil 50. Reference numeral R2 denotes a variable amount of impedance of the coil 45 which changes due to an eddy current which is generated in the metal body 41 when the metal body 41 passes into the magnetic lines of force generated by the coil 45. Inductances L of the coils 45 and 50 change as shown by the above equation. Elements of the first detecting circuit corresponding to those of the detecting circuit of FIG. 4 are designated by substantially the same reference numerals except that such numerals are followed by suffix "x" in FIG. 12A. Elements of the second detecting circuit corresponding to those of the detecting circuit of FIG. 4 are designated by substantially the same reference numerals except that such numerals are followed by suffix "y" in FIG. 12B.

The operation of the metal body discriminating apparatus will now be described with reference to FIGS. 13A to 13F. FIGS. 13B to 13F show waveform changes of AC signals $S_{1x}$, $SL_x$, and $Df_x$ which are generated by the first detecting circuit in FIG. 12A and waveform changes of AC signals $S_{1y}$, $SL_y$, and $Df_y$ which are generated by the second detecting circuit in FIG. 12B when the metal body 41 such as a coin or the like passes through the coils 45 and 50 of the discriminating sensors in the direction of arrow A shown in FIG. 13A.

Figure 13A:
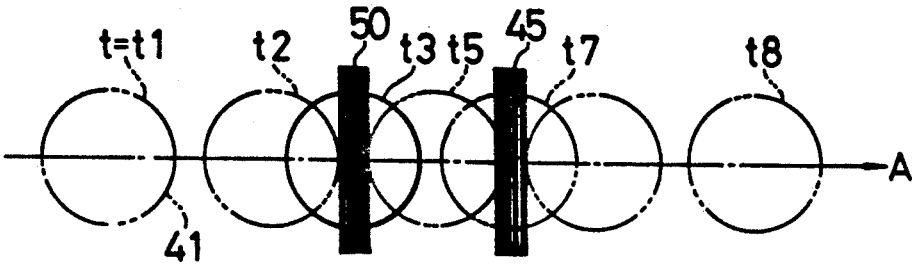
FIG. 13A is a timing diagram for explaining the operation of the second embodiment of the metal body discriminating apparatus.
Figure 13B:
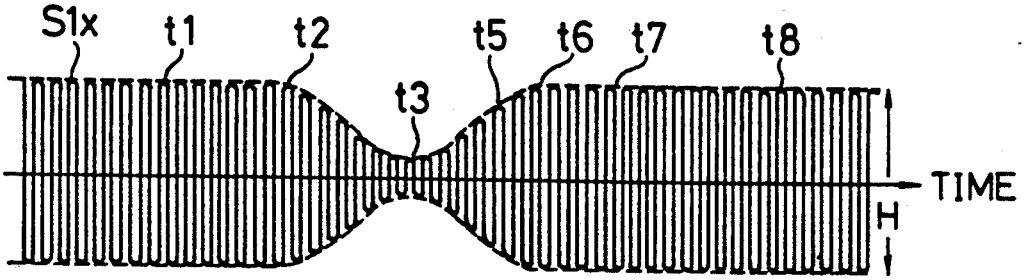
FIG. 13B is a waveform diagram showing a signal $S_{1x}$ in correspondence with the timing shown in FIG. 13A.
Figure 13C:
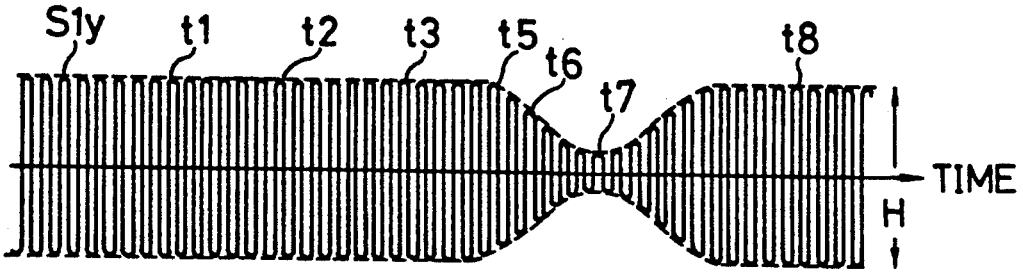
FIG. 13C is a waveform diagram showing a signal $S_{1y}$ in correspondence with the timing shown in FIG. 13A.

When the metal body 41 is away from both of the coils 50 and 45 as shown in a state before a time point $t_1$, the signals $S_{1x}$ and $S_{1y}$ each having the frequency and amplitude which are established only by the inductance of each of the coils 50 and 45 are generated by the detecting circuits (refer to FIGS. 13B and 13C). In response to the signals $S_{1x}$ and $S_{1y}$, the amplitudes of the signals $SL_x$ and $SL_y$ which are generated by detecting circuits 34x and 34y also have a predetermined value and frequencies of the signals $Df_x$ and $Df_y$ which are generated by the frequency detecting circuits 32x and 32y also have a predetermined value.

At time point $t_2$, when the front portion of the metal body 41 enters the space defined within the coil 50, an eddy current is generated in the front portion due to the magnetic lines of force, the inductance and impedance R1 of the coil 50 change, the frequency and amplitude of the signal $S_{1x}$ start to change, the amplitude of the signal $SL_x$ decreases, and the frequency of the signal $Df_x$ also starts to change. In the case where the metal body 41 is made of a material whose permeability is higher than that of the air, as shown in the diagrams, the frequency of the signal $S_{1x}$ decreases as more of the metal body 41 enters the space within the coil 50. (On the contrary, in the case where the metal body 41 is made of a material whose permeability is lower than that of air, the frequency of the signal $S_{1x}$ increases as more of the metal body 41 enters the space within the coil 50.)

When the metal body 41 further advances into the space within the coil 50, the eddy current which is generated also gradually increases. In response to such a change in eddy current, the frequency and amplitude of the signal $S_{1x}$, the envelope amplitude of the signal $SL_x$, and the frequency of the signal $Df_x$ also change.

At time point $t_3$, when the central portion of the metal body 41 coincides with the central portion of the coil 50, the eddy current which is generated in the metal body 41 becomes maximum, the amplitudes of the signals $S_{1x}$ and $Df_x$ become minimum, and the frequency of the signal $Df_x$ becomes minimum.

After time point $t_3$, the metal body 41 gradually moves away from the coil 50. Accordingly, the amplitudes and frequencies of the signals $S_{1x}$, $SL_x$, and $Df_x$ are gradually returned to those at time point $t_1$.

When the metal body 41 subsequently moves and the front portion of the metal body 41 enters the space within the coil 45, amplitudes and frequencies of signals $S_{1y}$, $SL_y$, and $Df_y$ of the second detecting circuit associated with the coil 45 start to change.

Figure 14:
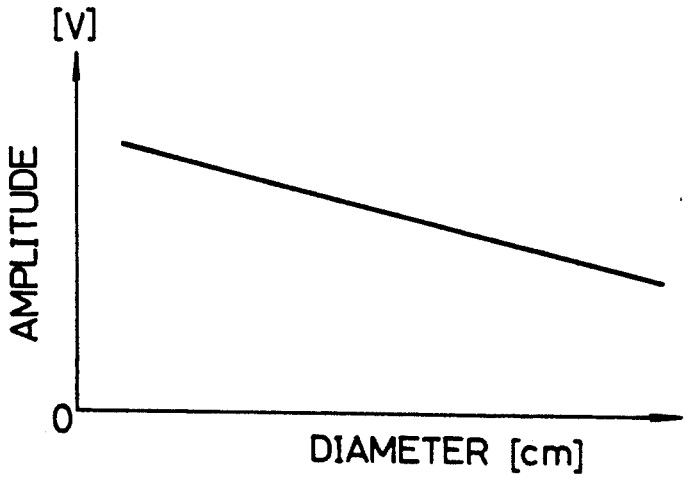
FIG. 14 is a graph of a characteristic of the detection signal generated by the second embodiment of the metal body discriminating apparatus.
Figure 15:
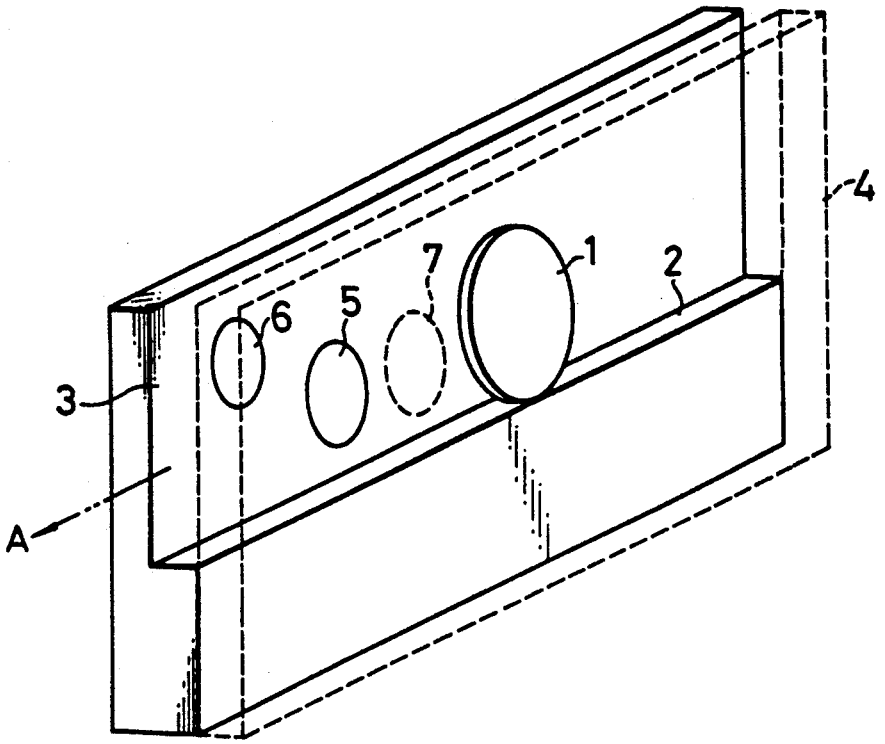
FIG. 15 is a schematic diagram of a structure of a conventional coin detecting apparatus.
Figure 16:
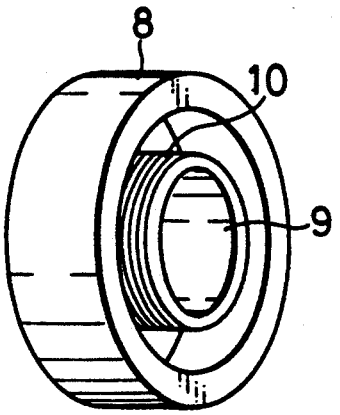
FIG. 16 is a perspective view of a conventional detecting sensor.
Figure 17:
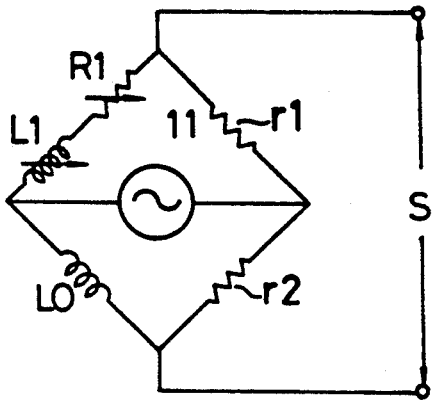
FIG. 17 is a circuit diagram of a detecting circuit using the conventional detecting sensor.
Figure 18:
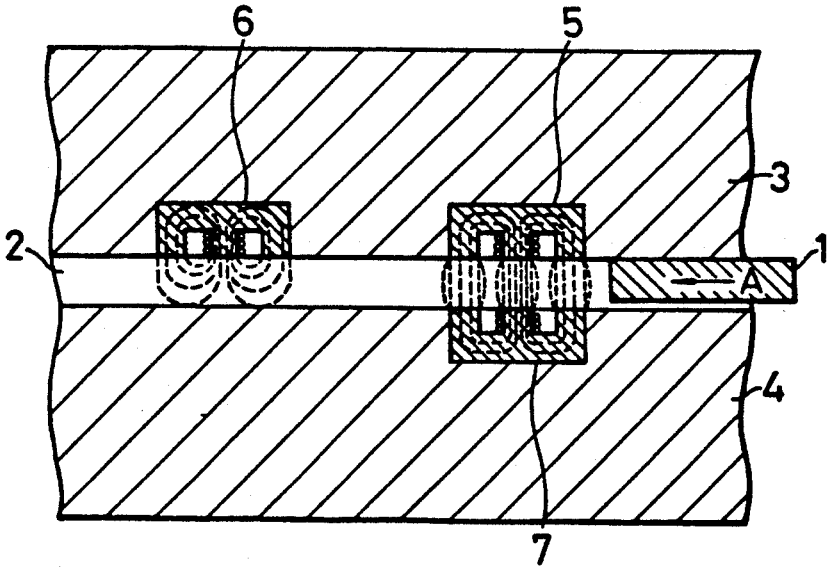
FIG. 18 is a horizontal cross-sectional view of the structure of a conventional coin detecting apparatus shown in FIG. 15.
Figure 19A:
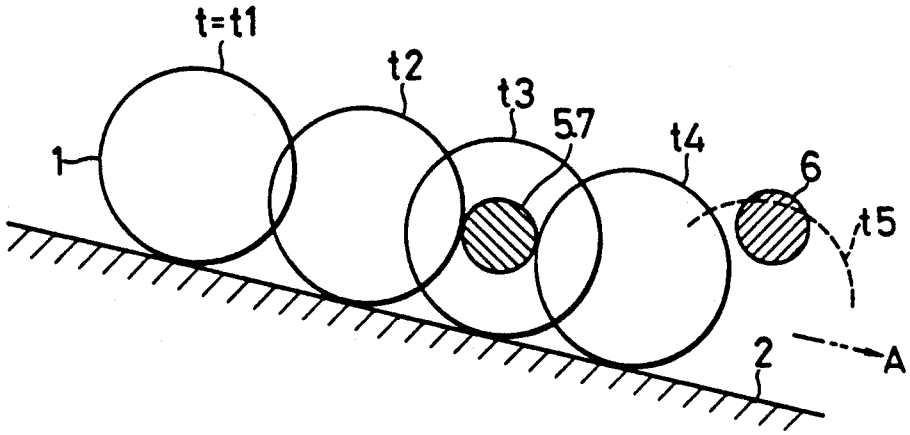
FIG. 19A is a schematic diagram for explaining the operation of the conventional coin detecting apparatus.
Figure 19B:
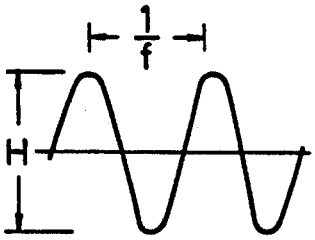
FIG. 19B is a waveform diagram of a signal S at a time point $t_1$ in FIG. 19A.
Figure 19C:
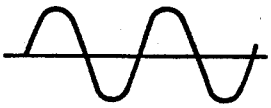
FIG. 19C is a waveform diagram of the signal S at a time point $t_2$ in FIG. 19A.
Figure 19D:
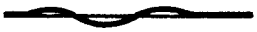
FIG. 19D is a waveform diagram of the signal S at a time point $t_3$ in FIG. 19A.

As shown at time $t_5$, when the amount of the metal body 41 within the coil 45 is equal to an amount of the metal body 41 within the coil 50, envelope amplitudes (indicated by $\Delta H$) of the signals $SL_x$ and $SL_y$ are equalized. In this embodiment, when the envelope amplitudes are equal, the signals $SL_x$ and $SL_y$ just cross, and the amplitude ΔH is detected at that time point. As shown in FIG. 14, since the amplitude ΔH is inversely proportional to the diameter of the metal body 41, data of the correlation between such characteristics can be previously stored in a memory circuit (not shown) such as a reference table or the like. By reading out the data in correspondence with the detected amplitude ΔH, the diameter of the metal body 41 is discriminated.

Further, after the metal body 41 has moved completely away from the coil 50 as at time point $t_6$, the amplitudes and frequencies of the signals $S_{1x}$, $SL_x$, and $Df_x$ of the first detecting circuit are returned to those at time point $t_1$.

On the other hand, when the maximum portion of the metal body 41 is within the coil 45 as shown at time point $t_7$, the amplitude of the signal $S_{1y}$ is a minimum value and the frequency also becomes minimum. In response, the amplitude of the signal $SL_y$ of the second detecting circuit is a minimum value $H_1$ and the frequency of the signal $Df_y$ becomes lowest.

After time point $t_7$, since the metal body 41 is moving gradually away from the coil 45, the amplitudes of the signals $S_{1y}$ and $SL_y$ increase and the frequency of the signal $Df_y$ is also returned to that at time point $t_1$. After the metal body 41 is completely away from the coil 45 at time point $t_8$, the characteristics of the signals $S_{1y}$, $SL_y$, and $Df_y$ are the same as those at time point $t_1$.

As mentioned above, the changes in amplitudes and frequencies of the signals $S_{1x}$, $SL_x$, $Df_x$, $S_{1y}$, $SL_y$, and $Df_y$ are indicative of features of the metal body 41. By analyzing those signals, coins or other metal bodies can be discriminated.

Figure 13D:
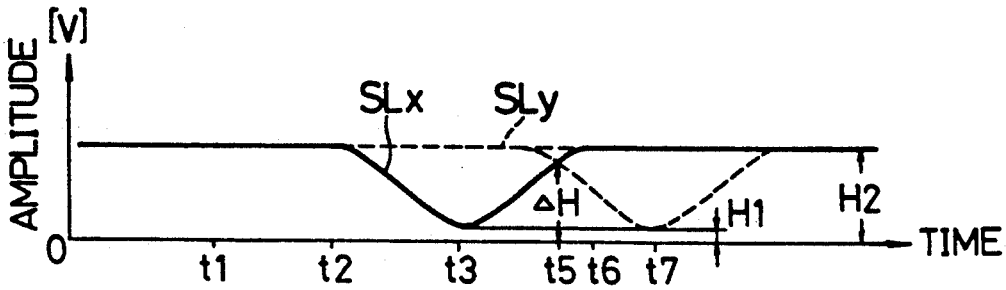
FIG. 13D is a waveform diagram showing signals $SL_x$ and $SL_y$ in correspondence with the timing shown in FIG. 13A.

Particularly, the amplitudes of the signals $S_{1x}$ and $SL_x$ decrease with an increase in the cross-sectional area AR of the metal body 41 and the frequencies of the signals $Df_x$ and $Df_y$ rise with increases in the permeability of the metal body 41. Therefore, as shown in FIG. 13D, a difference between the minimum amplitude $H_1$ and the maximum amplitude $H_2$ of the signal $SL_x$ or $SL_y$ is proportional to the cross-sectional area of the metal body 41 with a high degree of accuracy. The selection and discrimination of the metal body 41 can thus be realized from a viewpoint of its shape.

Further, as shown at time point $t_5$ in FIGS. 13A and 13D, when equal amounts of opposing portions of the metal body 41 extend within the coils 50 and 45, respectively, the signals $SL_x$ and $SL_y$ cross, so that the diameter of the metal body 41 can be accurately detected from the amplitude ΔH at such time.

Figure 13E:
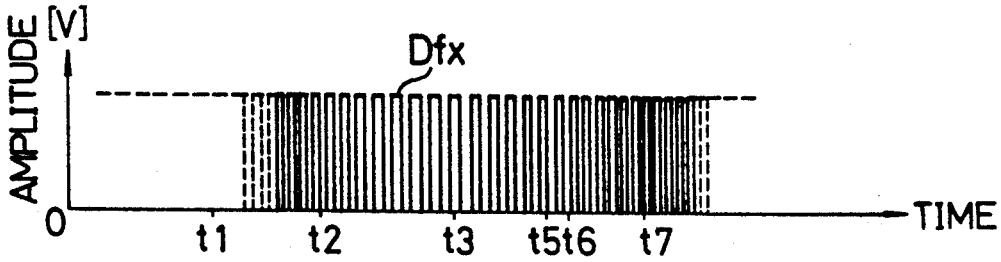
FIG. 13E is a waveform diagram showing a signal $Df_x$ in correspondence with the timing shown in FIG. 13A.
Figure 13F:
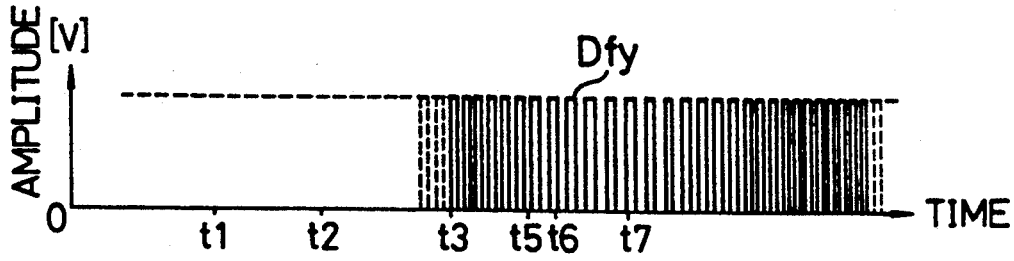
FIG. 13F is a waveform diagram showing a signal $Df_y$ in correspondence with the timing shown in FIG. 13A.

As shown in FIG. 13E or 13F, by detecting the frequency of the signal $Df_x$ or $Df_y$ at a time when the amplitude of the signal $SL_x$ or $SL_y$ has become minimum, the permeability of the metal body 41 can be determined. By examining the frequency, the metal body 41 can be selected and discriminated from a viewpoint of its material. By batch processing the above detection data, the discriminating process can be carried out with even high accuracy.

The present embodiment, in addition to providing the effects of the first embodiment shown in FIGS. 1 to 8, has an arrangement wherein the interval $W_3$ between the pair of coils is set to a value which is equal to the minimum diameter among the diameters of a plurality of kinds f metal bodies to be discriminated. Thus, if the amplitude ΔH is measured when the detection signals $SL_x$ and $SL_y$ generated by the detecting circuits connected to those coils cross, the diameter of the metal body can be detected with a high degree of accuracy. By applying this embodiment to a coin detecting apparatus, many kinds of coins can be discriminated with extremely high accuracy.

In the embodiment described above, the cores 53, 54, 55, and 56 have been provided so that the metal body will not be influenced by an external magnetic field and the magnetic lines of force between the coils 45 and 50. If the cores are used in an apparatus which is not influenced by an external magnetic field and the magnetic lines force between the coils 45 and 50, those cores can be omitted.

Further, although the above embodiment has been described with respect to the case where the discriminating sensor has a pair of coils 45 and 50, the number of cores is not limited to two cores. A plurality of coils can be arranged at predetermined intervals based on the sizes of metal bodies to be discriminated, and changes in detection signals can be processed together when the metal body passes into and through the respective coils, thereby achieving a complicated but highly accurate discriminating sensor.

The invention, accordingly, applies to all of the cases where two or more coils are used.

According to the metal body discriminating apparatuses of the invention as mentioned above, magnetic lines of force are generated by applying an AC current to the coil wound like a ring, and the metal body is moved through the space within the coil, thereby changing the impedance ad inductance of the coil due to the eddy current which is generated in the metal body by the magnetic lines of force. Thus, a change in AC signal corresponding to the changes in impedance and inductance becomes indicative of a feature of the metal body. Therefore, the invention can be applied to a wide range of metal body discriminating apparatuses because the structure is fairly simple and economical to produce, there is no portion requiring fine mechanical adjustments, the apparatus is not influenced by environmental conditions or the like, and the structure is relatively maintenance free.

Further, according to the invention, since a high degree of measuring accuracy can be maintained by using the central region of the coil where there is an extremely uniform and stable magnetic flux density, the metal body discriminating apparatus has a high degree of freedom in that it may be oriented in various directions and the metal body can move with high velocity. That is, the apparatus can be attached at various angles to vertical, horizontal, and oblique surfaces, and the like.

By providing two or more coils and setting the interval between the adjacent coils to a predetermined value based on a size such as a diameter or the like of the metal body to be measured, changes in impedance and inductance of each of the coils when the metal body passes sequentially through the coils are detected as phase deviations. The size, such as a diameter or the like, of the metal body can be discriminated with a high degree of accuracy from a change in frequency or amplitude of the signals detected having a phase deviation.

Although the embodiments have been described above with respect to the case of detecting coins which are used in Japan, the invention is not limited to those coins but can be also be applied to detect coins which are used in other countries. Even coins of different countries can be discriminated with a high degree of accuracy.

What is claimed is:

1. Apparatus for discriminating a metal body, said apparatus comprising:

a hollow body;

a self-oscillator having a coil wound around said hollow body and a feedback capacitive element operatively coupled to said coil, wherein a feedback voltage of the self-oscillator is applied to the capacitive element to generate a first AC signal;

first detecting means operatively electrically connected to said self-oscillator for detecting the frequency of the AC signal and for outputting signals indicative of the frequency on the basis of such detection; and second detecting means operatively electrically connected to said self-oscillator for detecting the amplitudes of the waveform of the AC signal and for outputting signals representative of the envelope of the AC signal based on such detection, whereby when a metal body passes through said hollow body and the space within said coil wound therearound, the amplitude and frequency of the AC signal changes such that the outputs of said detecting means discriminates the metal body.

2. An apparatus for discriminating a metal body as claimed in claim 1, wherein said self-oscillator comprises first and second capacitors, said first capacitor connected to one end of said coil, said second capacitor connected to the other end of said coil, and a comparitor connected to opposite ends of said first capacitor so as to compare a potential at one end of said first capacitor with a predetermined potential and apply a voltage to the other end of the first capacitor based on the comparison.

3. An apparatus for discriminating a metal body as claimed in claim 1, wherein said hollow body has an inner peripheral surface of a shape complimentary to that of a coin.

4. Apparatus for discriminating a metal body, said apparatus comprising:

a hollow body;

a first self-oscillator having a first coil wound around said hollow body and a feedback capacitive element operatively coupled to said first coil, wherein a feedback voltage of the self-oscillator is applied to the capacitive element to generate a first AC signal;

a second self-oscillator having a second coil wound around said hollow body and a feedback capacitive element operatively coupled to said second coil, wherein a feedback voltage of the second self-oscillator is applied to the capacitive element thereof to generate a second AC signal;

said coils being spaced from one another along said hollow body by a predetermined distance;

first detecting means operatively electrically connected to said first self-oscillator for detecting the frequency of the first AC signal and for outputting signals indicative of the frequency of the first AC signal on the basis of such detection;

second detecting means operatively electrically connected to said first self-oscillator for detecting the amplitudes of the waveform of the first AC signal and for outputting signals representative of the envelope of the first AC signal based on such detection;

third detecting means operatively electrically connected to said second self-oscillator for detecting the frequency of the second AC signal and for outputting signals indicative of the frequency of the second AC signal on the basis of such detection; and fourth detecting means operatively electrically connected to said second self-oscillator for detecting the amplitudes of the waveform of the second AC signal and for outputting signals representative of the envelope of the second AC signal based on such detection, whereby when a metal body, having a maximum dimension greater than that of the distance between respective terminal windings of said coils that are closest to one another, passes through said hollow body and the spaces defined within said coils wound therearound, the amplitude and frequency of the AC signals change such that the outputs of said first and second detecting means when compared to the outputs of said third and fourth detecting means discriminate the metal body.

5. An apparatus for discriminating a metal body as claimed in claim 4, wherein each of said first and said second self-oscillators comprises respective first and second capacitors, said first capacitor connected to one end of said coil thereof, said second capacitor connected to the other end of said coil thereof, and a comparitor connected to opposite ends of said first capacitor thereof so as to compare a potential at one end of said first capacitor thereof with a predetermined potential and apply a voltage to the other end of the first capacitor thereof based on the comparison.

6. An apparatus for discriminating a metal body as claimed in claim 4, wherein said hollow body has an inner peripheral surface of a shape complimentary to that of a coin.

7. In a machine including a metal body discriminating apparatus having a detection coil through which a metal body is passed so as to be magnetically discriminated, the improvements comprising:

a self-oscillator made up of said detection coil and a feedback capacitive element operatively coupled to said detection coil, and wherein a feedback voltage of the self-oscillator is applied to the feedback capacitive element to generate an AC signal;

first detecting means operatively electrically connected to said self-oscillator for detecting a frequency of the AC signal and for outputting signals indicative of the frequency on the basis of such detection; and second detecting means operatively electrically connected to said self-oscillator for detecting the amplitudes of the wave form of the AC signal and for outputting signals representative of the envelope of the AC signal based on such detection, whereby when a metal body passes through the space within said detection coil, the amplitude and frequency of the AC signal changes such that the outputs of said detecting means discriminates the metal body.

8. An apparatus according to claim 7, wherein said self-oscillator comprises first and second capacitors, said first capacitor connected to one end of said detection coil, said second capacitor connected to the other end of said detection coil, and a comparator connected to opposite ends of said first capacitor so as to compare a potential at one end of said first capacitor with a predetermined potential and apply a voltage to the other end of the first capacitor based on the comparison.

9. In a machine including a metal body discriminating apparatus having first and second detection coils thorugh which a metal body is passed so as to be magnetically discriminated, the improvements comprising:

a first self-oscillator made up of said first detection coil and a first feedback capacitive element operatively coupled to said first detection coil, wherein a feedback voltage of the first self-oscillator is applied to the first feedback capacitive element to generate a first AC signal;

a second self-oscillator made up of said second detection coil and a second feedback capacitive element operatively coupled to said second detection coil, wherein a feedback voltage of the second self-oscillator is applied to the second feedback capacitive element to generate a second AC signal;

said first and second detection coils being spaced from one another by a predetermined distance;

first detecting means operatively electrically connected to said first self-oscillator for detecting a frequency of the first AC signal and for outputting signals indicative of the frequency of the first AC signal on the basis of such detection;

second detecting means operatively electrically connected to said first self-oscillator for detecting the amplitude of the waveform of the first AC signal and for outputting signals representative of the envelope of the first AC signal based on such detection;

third detecting means operatively electrically connected to said second self-oscillator for detecting a frequency of the AC second signal and for outputting signals indicative of the frequency of the second AC signal on the basis of such detection; and fourth detecting means operatively electrically connected to said second self-oscillator for detecting the amplitude of the waveform of the second AC signal and for outputting signals representative of the envelope of the second AC signal based on such detection;

whereby when a metal body, having a maximum dimension greater than that of the distance between respective terminal windings of said detection coils that are closest to one another, passes through spaces defined within said detection coils, the amplitude and frequency of the AC signals change such that the outputs of said first and second detecting means when compared to the outputs of third and fourth detecting means discriminate the metal body.

10. The improvements in a machine including a metal body discriminating apparatus according to claim 9, wherein each of said first and second second self-oscillators comprises respective first and second capacitors, said first capacitor connected to one end of said detection coil thereof, the second capacitor connected to the other end of said detection coil thereof, and a comparator connected to opposite ends of said first capacitor thereof so as to compare a potential at one end of said first capacitor thereof with a predetermined potential and apply a voltage to the other end of the first capacitor thereof based on the comparison.

* * * * *